US005406258A

United States Patent [19]

Carver

[11] Patent Number: 5,406,258

[45] Date of Patent: Apr. 11, 1995

[54] PRESSURIZED SECURITY BARRIER AND ALARM SYSTEM

[75] Inventor: Don W. Carver, Knoxville, Tenn.

[73] Assignee: The United States of America as represented by the United States Department of Energy, Washington, D.C.

[21] Appl. No.: 233,677

[22] Filed: Apr. 26, 1994

[51] Int. Cl.[6] ..... G08B 13/20

[52] U.S. Cl. ..... 340/544; 340/541; 340/626

[58] Field of Search ..... 340/544, 541, 626; 116/70

[56] References Cited

U.S. PATENT DOCUMENTS

| | | | |
|---|---|---|---|
| 741,573 | 10/1903 | Ballou | 340/544 |
| 3,753,260 | 8/1973 | Nelkin et al. | 340/544 |
| 4,791,410 | 12/1988 | Larsson | 340/544 |

FOREIGN PATENT DOCUMENTS

| | | | |
|---|---|---|---|
| 2592511 | 7/1987 | France | 340/544 |
| 2128649 | 5/1984 | United Kingdom | 340/544 |

*Primary Examiner*—Glen Swann

*Attorney, Agent, or Firm*—David E. Breeden; Stephen D. Hamel; William R. Moser

[57] ABSTRACT

A security barrier for placement across a passageway is made up of interconnected pressurized tubing made up in a grid pattern with openings too small to allow passage. The tubing is connected to a pressure switch, located away from the barrier site, which activates an alarm upon occurrence of a pressure drop. A reinforcing bar is located inside and along the length of the tubing so as to cause the tubing to rupture and set off the alarm upon an intruder's making an attempt to crimp and seal off a portion of the tubing by application of a hydraulic tool. Radial and rectangular grid patterns are disclosed.

12 Claims, 2 Drawing Sheets

PRESSURIZED SECURITY BARRIER AND ALARM SYSTEM

ORIGIN OF THE INVENTION

This invention was made under Contract No. DE-AC05-84OR21400 between Martin Marietta Energy Systems, Inc., and the U.S. Department of Energy.

FIELD OF THE INVENTION

This invention relates generally to physical security measures and more particularly to barriers and alarm devices for preventing intrusion into and escape from secured areas.

2. Background of the Invention

Various types of barriers, sensors, and alarms have been used to protect secured area perimeters from unauthorized entry or exit. Existing physical security systems generally utilize sensors, motion detection devices, or the like which include electronic components operating in the secured site and which require a power supply and wiring components at the site. While satisfactory for use in normal rooms and passageways, such systems are not well suited for placement in passageways that may be operating in harsh environments, in particular, sewers and other drains as well as certain vents and ducts. Corrosive atmospheres and extremes in temperatures may have an adverse effect on sensors and electronic components, resulting in decreased reliability. In addition to avoiding placement of sensitive components at the security barrier site, it is desired to provide a barrier with a built-in anti-tampering feature that would cause an alarm to sound if the barrier is breached or tampered with, without relying on the functioning of electronic components at the site.

SUMMARY OF THE INVENTION

The present invention is directed to a physical security barrier made up of pressurized metal tubing arranged in a grid pattern for placement across a passageway, with the tubing of the barrier being in communication with a pressure switch located away from the secured area. The pressure switch is coupled to an alarm circuit at a remote location so as to activate the alarm upon the occurrence of a pressure drop in the tubing.

The barrier tubing is arranged in a grid pattern with openings through the grid being too small to allow the passage of a person through the barrier. In order to preclude tampering as by attempting to pinch off a segment of tubing in the grid by application of a hydraulic tool so as to allow a breach without causing a pressure drop, the tubing is provided with an internal enhancement in the form of a reinforcing bar along the length of the tubing. Edges of the bar cause the tubing to be ruptured, producing a pressure drop before the tubing can become sealed off by application of a tool.

The pressure switch, inaccessible from the barrier site on a tubing line extending away from the grid, may be placed in a closed box along with a pressure supply line, pressure gauge, and other fittings as required, with the box including a tamper switch which activates an alarm upon entry therein. An alarm circuit is coupled to the pressure switch at a remote site to activate an alarm upon occurrence of a drop in pressure below a predetermined level.

Barriers embodying the invention provide a sensing mechanism that operates without requiring electronic components or a power supply at the secured site, improving reliability of the system, and reducing maintenance requirements. Breaching of the barrier by attempting to seal off and remove a portion of the grid is precluded by the presence of the internal bar in the tubing.

It is therefore an object of this invention to provide a physical security barrier having a built-in sensing mechanism that does not require use of electronic components at a secured site.

Another object is to provide a barrier that activates an alarm when tampering with the barrier is attempted.

Yet another object is to provide a physical security system having a barrier with a built-in sensing mechanism for activating an alarm at a site remote from a secured area.

Other objects and advantages of the invention will be apparent from the following detailed description and the appended claims.

DESCRIPTION OF THE PREFERRED EMBODIMENT

Figure 1:
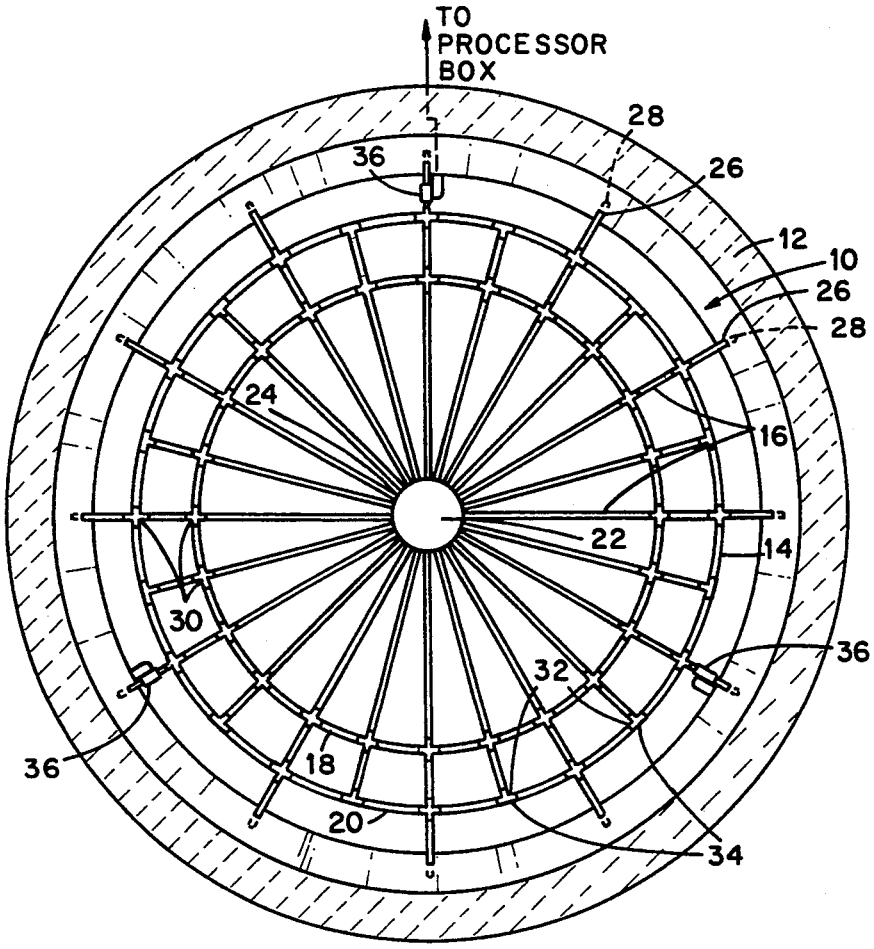
FIG. 1 is an end view, partially in section, showing a barrier embodying the invention disposed across a drain pipe.

Referring to FIG. 1 of the drawings, there is shown a barrier 10 disposed across a drain pipe 12 perpendicular to the length of the pipe, the pipe being a conventional 72-inch diameter concrete drainpipe. The barrier is made up of a coplanar array of reinforced metal tubing 14 formed into a pattern of radial spokes 16, spaced-apart circumferential rings 18, 20, and a central hub 22. Open spaces in the pattern are kept small enough to prevent passage therethrough of a human being. The spokes 16 have their inner ends 24 secured in holes (not shown) in hub 22 and outer ends 26 of alternating spokes embedded in holes 28 in the concrete pipe. Shorter spokes between the alternating embedded spokes have their outer ends 32 connected to T-fittings 34 forming a portion of inner ring 18. The metal tubing parts which make up the rings and spokes of the barrier are arranged in a co-planar array,and four-way female fittings 30 or T-fittings 34, which receive ends of the parts, are provided at all intersections. Tubing ends and fittings are securely joined to provide pressure-tight joints, which may be obtained by conventional welding.

Three of the spokes 16 at locations spaced inward from embedded ends 26 have T-fittings 36, each communicating with tubing part 38 which forms a manifold for monitoring of pressure throughout the barrier. Three of the spokes, located 120° apart from one another, are provided with these T-fittings. Tubing part 38 is connected to a pressure switch activated by a sensed pressure drop as will be described below.

Figure 2:
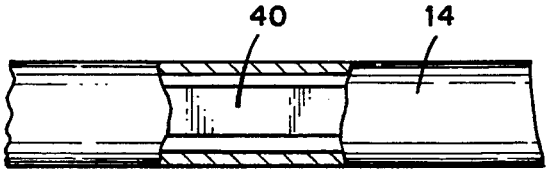
FIG. 2 is a planar view, partly broken away, showing a segment of a pressurized tube with an internal reinforcing bar.

As shown in FIG. 2, the tubing 14 has an internal bar 40 having a square cross section extending along the length of the tubing. This prevents the tubing from being sealed off in tampering attempts using tools such as hydraulic clamping devices. The tubing may be made of stainless steel and have a diameter of one-half inch, with the bar having a square cross section 3/16 inch across. Lightweight tubing having a wall thickness of 0.065 inch or less is preferred to enable puncturing to occur quickly when tampered with. The tubing should be bent to the correct diameter before cutting in preparation of curved parts, and a length of square bar is preferably dropped inside each section of tubing prior to welding.

Figure 3:
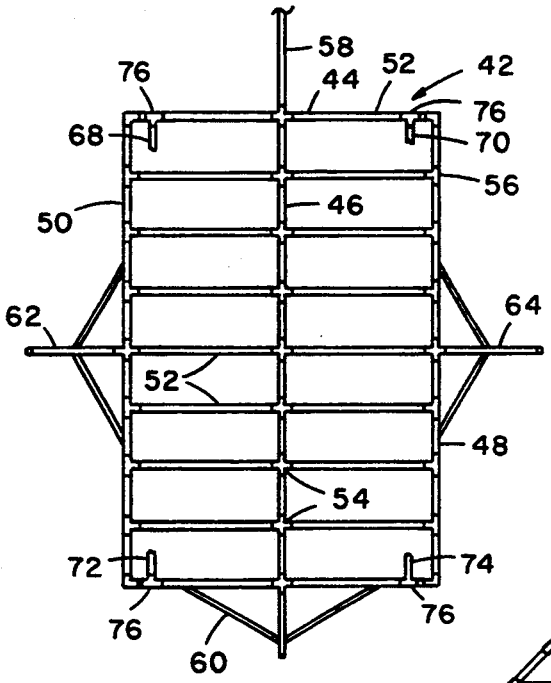
FIG. 3 is an end view of a pressurized barrier made up in a rectangular grid pattern.
Figure 4:
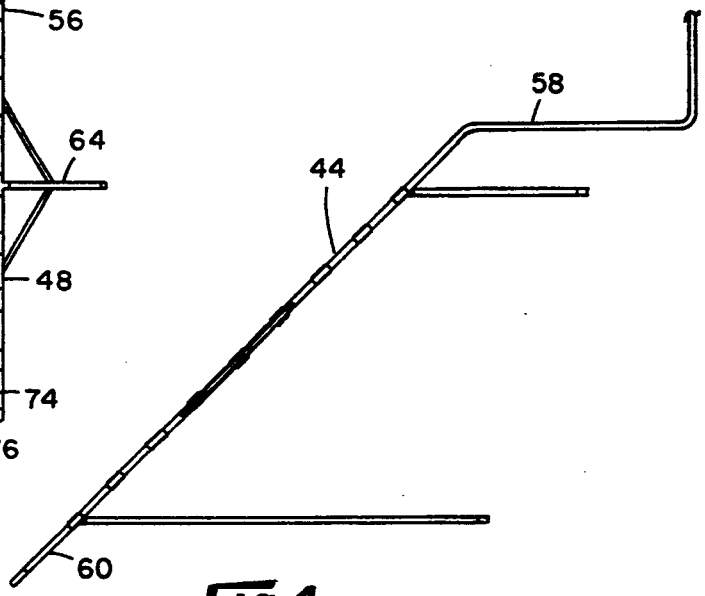
FIG. 4 is a side view of the barrier of FIG. 3.

FIGS. 3 and 4 show a barrier 42 made up of a horizontal grid 44 of tubing containing a steel bar of the same structure as described for FIG. 1. The horizontal grid has an elongated middle vertical member 46 and side members 48, 50 and a plurality of horizontal members 52 made up of interconnected parts joined by four-way female fittings 54 and T-fittings 56 as shown. Connections to walls of pipe of duct work are made by suitable connectors (not shown) attached to framework members 58, 60, 62, and 64 at the top, bottom,and sides, respectively, of the grid. A network of pressurized tubing is provided for monitoring of pressure inside the grid and for communicating the grid with a pressure switch. The network is made up of tubes 68, 70 joined to the top horizontal member 52 and tubes 72, 74 joined to the bottom horizontal member by T-fittings 76. The tubes 68, 70, 72, and 74 are connected to one another and to the pressure switch by means not shown. The horizontal grid may be used as a barrier for vent and duct work having a rectangular cross section, and, by providing additional tubes around the outer edges as required to close openings around the edges, for circular pipes and passageways. As shown in FIG. 4, the grid is tilted diagonally in order to minimize obstruction of a typical drain by trash such as floating plastic bags.

Figure 5:
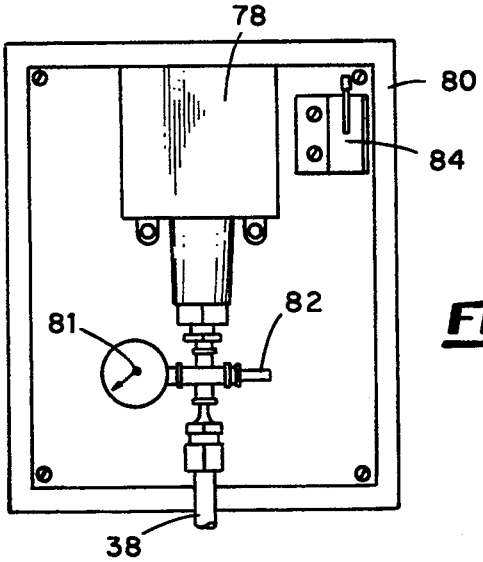
FIG. 5 is a top view of a processor box.

FIG. 5 shows a pressure switch 78 and other components located within a housing 80, preferably in a location inaccessible from the protected side of the barrier. Input tubing member 38, in communication with the pressurized barrier tubing, is connected to the pressure switch through fittings in communication with a pressure gauge 81 and a pressure valve 82 for introduction of pressurizing gas along with a pressure relief valve (not shown). As an added precaution, a tamper switch 84 is operably connected to the lid of the housing so as to activate the system alarm in the event that the box is opened by an intruder.

Although the invention is not limited to a specific pressure, it is preferred to operate the barrier system at a pressure of 20 to 22 PSIG using air as the pressurized gas, with an alarm set point of 10 PSIG. A suitable pressure switch is a Model 701, United Electric H100, adjustable from 3 to 30 PSIG, and the tamper switch may comprise a Model B2-2RL2-A2 available from Micro Switch Corporation. The input air valve may comprise a conventional valve of the type used for inflating air tanks and pneumatic tires. Both the pressure switch and the tamper switch are preferably single pole, double throw switches.

Figure 6:
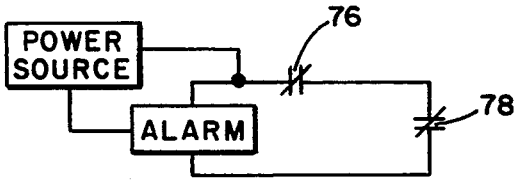
FIG. 6 is a schematic view of a circuit for activating an alarm in response to a barrier pressure drop.
Figure 7:
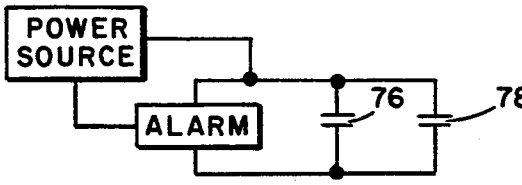
FIG. 7 is an alternate circuit for activating the alarm.

FIGS. 6 and 7 schematically show circuits interconnecting the pressure and tamper switches and the alarm activated by the switches. In the arrangement shown in FIG. 6, both switches are closed when the system is secure, while in FIG. 7, both switches are open when the system is secure.

The invention is not to be understood as limited to the embodiments described above, but is limited only as indicated by the appended claims.

I claim:

1. A barrier for placement across a passageway so as to secure the passageway comprising:

a grid of interconnected metal tubing members adapted to contain a pressurized gas and arranged in a pattern having no openings large enough to allow passage of a person therethrough;

said tubing members of said grid having reinforcing means disposed therein along the length of said members;

means adapted for securing said grid to walls of said passageway;

a pressure switch responsive to a drop in pressure within said grid; and conduit means communicating said grid with said pressure switch.

2. A barrier as defined in claim 1 wherein said metal tubing has a circular cross section, and said reinforcing means comprises a metal bar having a square cross section.

3. A barrier as defined in claim 2 wherein said grid comprises radial spokes, a central hub, and a plurality of circumferential, space-apart rings.

4. A barrier as defined in claim 2 wherein said grid comprises a plurality of vertical and horizontal members arranged in a rectangular pattern.

5. A security barrier and alarm system responsive to attempts to breach said barrier comprising:

a barrier comprising a grid adapted to be placed across a passageway having a defined geometry comprising:

a grid of interconnected metal tubing members adapted to contain a pressurized gas and arranged in a pattern having no openings therethrough large enough to allow passage of a person;

said tubing members having an internal reinforcing means of different cross-sectional shapes than the tubing disposed along the length of the tubing;

means securing edges of said grid to walls of said passageway;

a pressure switch adapted to produce a signal when gas pressure to which it is exposed drops below a predetermined level;

a conduit communicating said grid with said pressure switch; and an alarm operably connected to said pressure switch whereby said alarm will be activated upon production of said signal by said pressure switch.

6. The barrier and alarm system as defined in claim 5 wherein said pressure switch is located in a housing inaccessible from the site of said barrier.

7. The barrier and alarm system as defined in claim 6 including in said housing a tamper switch connected to said alarm whereby the alarm will be activated upon occurrence of tampering with said housing.

8. The barrier and alarm system as defined in claim 6 including an inlet pressure valve for introducing pressurized gas into said grid.

9. The barrier and alarm system as defined in claim 8 wherein said gas is air.

10. The barrier and alarm system as defined in claim 9 wherein said air is maintained at an operating pressure of 20 to 22 PSIG, and said predetermined level for activating said switch is 10 PSIG.

11. The barrier and alarm system as defined in claim 5 wherein said reinforcing means is a metal bar having a rectangular cross section.

12. The barrier and alarm system as defined in claim 11 wherein said tubing is stainless steel tubing having a diameter of one-half inch, and said metal bar is a 3/16-inch square steel bar.

* * * * *